US010654192B1

(12) United States Patent
Palermo

(10) Patent No.: US 10,654,192 B1
(45) Date of Patent: May 19, 2020

(54) CONCRETE WASHOUT AND WATER RECYCLING APPARATUS

(71) Applicant: Chad Palermo, Anaheim Hills, CA (US)

(72) Inventor: Chad Palermo, Anaheim Hills, CA (US)

( * ) Notice: Subject to any disclaimer, the term of this patent is extended or adjusted under 35 U.S.C. 154(b) by 0 days.

(21) Appl. No.: 16/248,541

(22) Filed: Jan. 15, 2019

(51) Int. Cl.
*B28C 5/42* (2006.01)
*B08B 9/08* (2006.01)

(52) U.S. Cl.
CPC ..... *B28C 5/4231* (2013.01); *B08B 9/0804* (2013.01); *B28C 5/4258* (2013.01); *B28C 5/4272* (2013.01)

(58) Field of Classification Search
CPC combination set(s) only.
See application file for complete search history.

(56) References Cited

U.S. PATENT DOCUMENTS

| | | | |
|---|---|---|---|
| 6,039,468 | A | 3/2000 | Kowalcyzk |
| 6,155,277 | A | 12/2000 | Barry |
| 8,020,569 | B2 | 9/2011 | Leonardich |
| 8,079,746 | B2 | 12/2011 | Lundberg |
| 8,734,587 | B2 | 5/2014 | Pruyn |
| 2006/0059653 | A1 | 3/2006 | Mickelson |
| 2007/0256707 | A1 | 11/2007 | Leonardich |
| 2012/0187034 | A1 | 7/2012 | Shaw |

*Primary Examiner* — Erin F Bergner
(74) *Attorney, Agent, or Firm* — Eric Karich; Karich & Associates

(57) ABSTRACT

A concrete washout and water recycling apparatus has a water tank with a capacity of at least 250 gallons, having an input aperture in a top portion of the water tank, and an outlet aperture on a bottom portion of the water tank, which has a release valve. The apparatus further includes a mounting structure for mounting the water tank on the cement truck, and a water channeling system. The system has a first pipe and a second pipe, the first pipe having a proximal end, a distal end, and a diameter, the proximal end being connected to the input aperture of the water tank. The second pipe has first end, a second end, and a diameter, the first end being connected to the distal end of the first pipe, and the second end having a connector valve.

2 Claims, 3 Drawing Sheets

CONCRETE WASHOUT AND WATER RECYCLING APPARATUS

BACKGROUND OF THE INVENTION

Field of the Invention

This invention relates generally to concrete washout systems and methods, and more particularly to a concrete washout and water recycling apparatus that is adapted to be installed on a cement truck.

Description of Related Art

It is common practice when pouring concrete to use a concrete pump to pump the concrete from the cement truck to the slab being poured. Standard practice following use of the concrete pump is to run water through the pump and associated conduits to flush the concrete from them. Using prior art procedures, the concrete pump is attached to a hook-shaped tube called a washout hook, which is then placed into an opening of a mixing drum of the cement truck. Any remaining concrete is pumped into the mixing drum, and then all of the waste water flushing through the pump is also pumped into the mixing drum, until the pump is suitably clean.

While this process is quick and easy, there are several downsides. First, any concrete remaining in the mixing drum is ruined by the waste water which is poured into the mixing drum. Second, a great deal of water is wasted. Third, the watery sludge that is left in the mixing drum must be poured into a waste pit for drying, which is harmful to the environment, unsightly, and also laborious to maintain.

The present invention enables the separation of the leftover concrete, which may then be used on other jobs, from the waste water, which may be recycled.

There are various other water-catching systems in the prior art which catch waste water; however, they are adapted to enable completely different systems. They are typically used for small-scale cleaning of specific components of the cement truck, such as the concrete chute at the back of the truck. They are small in size (less than 100 gallons), and do not enable cleaning the concrete pump without use of the mixing drum of the cement truck.

Pruyn, U.S. Pat. No. 8,734,587, teaches an apparatus and method for washing, storing and transporting waste washed from concrete chutes of a mixing truck. The apparatus comprises a fluid container with a volume of about 25 gallons, a first opening, a drainpipe, and a pair of arms extending upwardly above the container. Each end of the arms distal from the container is adapted to mate with a first concrete chute member such that the first chute member is disposed above the first opening in the fluid container. A second concrete chute member attached to the concrete mixing truck can be positioned above the first concrete chute member. Waste flows down the chutes, through a strainer basket, and into the fluid container, wherein the waste can be disposed via the drainpipe.

Lundberg, U.S. Pat. No. 8,079,746, teaches a method, and apparatus for removing cement residue located within a concrete discharge chute, and controlling the collection of debris and wash water in a concrete mixing truck. A barrier plate having a rubber seal is connected to the end of the discharge chute. When concrete discharge is completed, the barrier plate automatically prevents the discharge of debris by closing off the discharge chute when it is raised into an upright position. The barrier plate also has an opening fitted with a valve which may be connected to a drain/conduit hose to collect wash water into a fluid collection tank securely positioned on the cement truck.

Leonardich, U.S. Pat. No. 8,020,569, teaches a portable washout and cleanup facility and method of use. A water holding tank can be mounted on the facility, and comprises a vent at the top, a large opening with cover and a drain, a washout tub, and a means for conveying water. Water can be conveyed from the water holding tank to clean concrete sediment through a hose. The water can then be separated from the concrete and conveyed back into the water holding tank using a hose and a strainer.

Barry, U.S. Pat. No. 6,155,277, teaches an apparatus for containing and filtering waste from washing the hopper and discharge chute of a concrete truck. The apparatus comprises a container removably mountable on the end of the discharge chute, the container having an open upper end, a screen to prevent clogging of the pump fittings, and an outlet located in a lower portion of the container, below the screen. The apparatus further includes a standard concrete pump mountable on the truck, with a discharge hose extending from the pump to a mixing drum. In operation, waste is flushed down the chute and into the container, and automatically conveyed through the suction and discharge hoses into the mixing drum.

The prior art teaches apparatuses and methods for concrete waste water removal. However, the prior art flushes water into the mixing drum, which ruins the concrete, wastes water, and creates large amounts of waste materials. Therefore, the prior art does not teach an apparatus and method that saves a large volume of water and enables use of the concrete remaining in the mixing drum. The present invention fulfills these needs and provides further advantages as described in the following summary.

SUMMARY OF THE INVENTION

The present invention teaches certain benefits in construction and use which give rise to the objectives described below.

The present invention provides concrete washout and water recycling apparatus for use in association with a cement truck with a mixing drum, and a concrete pump with a discharge conduit. The apparatus includes a water tank, which has a capacity of at least 250 gallons, an input aperture in a top portion of the water tank, and an outlet aperture on a bottom portion of the water tank, which has a release valve. The apparatus further includes a mounting structure adapted for mounting the water tank on the cement truck, and a water channeling system. The system comprises a first pipe and a second pipe, the first pipe having a proximal end, a distal end, and a diameter, the proximal end being connected to the input aperture of the water tank. The second pipe has first end, a second end, and a diameter, the first end being connected to the distal end of the first pipe, and the second end having a connector valve. The diameter of the second pipe is smaller than the diameter of the first pipe.

A primary objective of the present invention is to provide a concrete washout and water recycling apparatus having advantages not taught by the prior art.

Another objective is to provide a concrete washout and water recycling apparatus having a water channeling system and washout hook that prevent water from ruining concrete or contaminating adjoining waterways.

Another objective is to provide a concrete washout and water recycling apparatus and method that conserves water and prevents the generation of waste materials.

Another objective is to provide a concrete washout and water recycling apparatus having a water tank with a volume of at least 250 gallons.

Another objective is to provide a system that enables the use on a second job of any concrete remaining in the mixing drum of a concrete truck after a first job is completed.

A further objective is to provide a concrete washout and water recycling apparatus and method that conserves water and prevents the generation of waste materials.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a concrete washout and water recycling apparatus 10 for use in cleaning a concrete pump 20 and in association with a cement truck 30.

Figure 1:
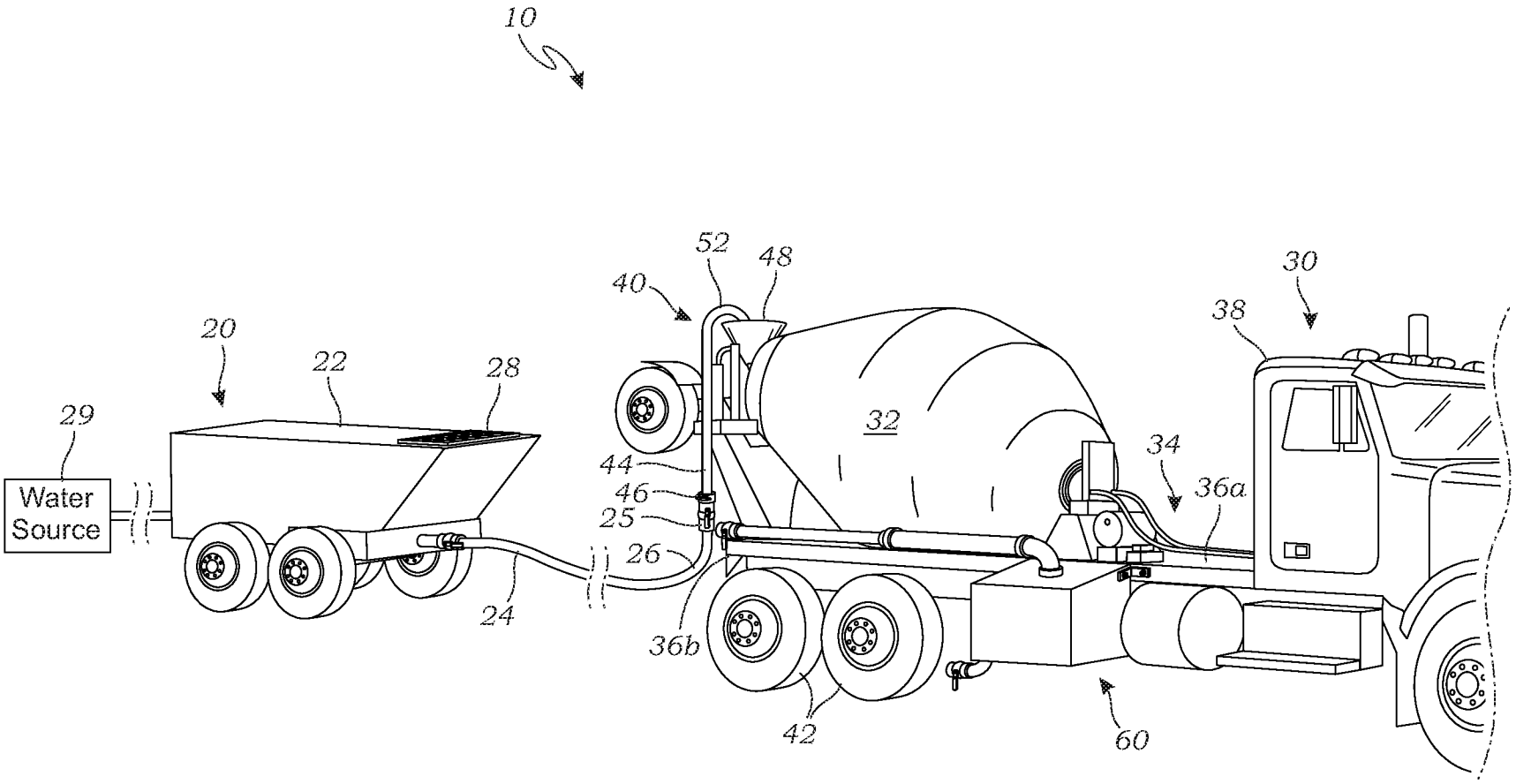
FIG. 1 is a perspective view of a cement truck having a concrete washout and water recycling apparatus installed thereupon, illustrating a discharge conduit of a concrete pump operably connected to a washout hook of the cement truck.
Figure 2:
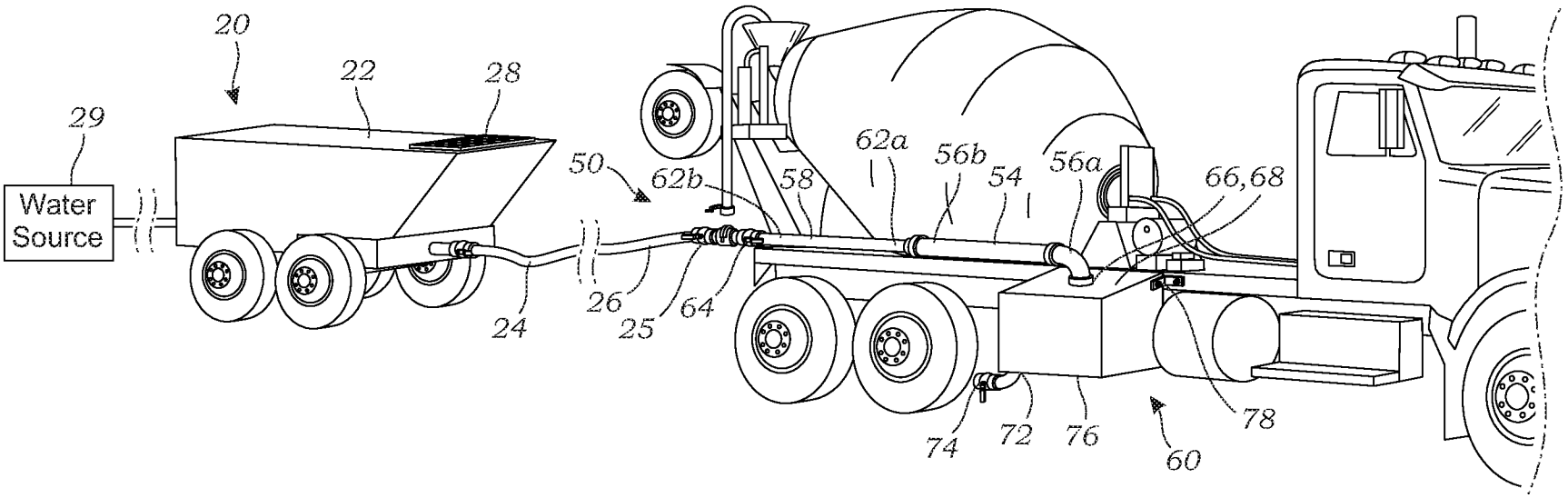
FIG. 2 is a perspective view thereof, illustrating the discharge conduit operably connected to a water channeling system of the concrete washout and water recycling apparatus.

FIGS. 1 and 2 are perspective views of one embodiment of the concrete washout and water recycling apparatus 10 installed on the cement truck 30. FIG. 1 illustrates the concrete pump 20 operably attached to the washout hook 40, for an initial pumping operation for pumping any concrete remaining in the concrete pump 20 into the cement truck 30. FIG. 2 illustrates the concrete pump operably attached to the concrete washout and water recycling apparatus 10 (hereinafter, "the apparatus"), for a second pumping operation for pumping waste water through the concrete pump into a water tank 60 of the apparatus 10.

As shown in FIGS. 1 and 2, the cement truck 30 has standard features known to those in the art, as needed for functionality in concrete mixing and transportation. The cement truck 30 includes a mixing drum 32 operably mounted on a body frame 34 that extends from a front end 36*a* attached to a cab 38, to a back end 36*b* operably supported on tires 42. Since the general construction of the cement truck 30 is well known, it is not described in greater detail herein.

The concrete pump 20, also generally known in the art, includes a pump housing 22 with a receiver/grate 28 for receiving a flow of concrete from the cement truck 30. The pump 20 includes a discharge conduit 24 for directing the flow of concrete to the worksite, where a slab is being poured. In this embodiment, the concrete pump 20 further includes a discharge valve 25 at a discharge end 26 of the discharge conduit 24 for enabling regulation of the flow of the concrete and/or waste water from the concrete pump 20.

As shown in FIG. 2, the apparatus 10 includes a water channeling system 50 and a water tank 60 operably mounted on the cement truck 30. In this embodiment, the water channeling system 50 includes a first pipe 54 having a proximal end 56*a* and a distal end 56*b*, and a second pipe 58 having a first end 62*a* and a second end 62*b*.

In this embodiment, the water channeling system 50 is constructed longitudinally along the length of the cement truck 30, with the proximal end 56*a* of the first pipe 54 being attached to the water tank 60, which in this embodiment is mounted adjacent the proximal end 36*a* of the body frame 34. In this embodiment, the proximal end 56*a* is operably connected to an input aperture 66 on a top portion 68 of the water tank 60.

The distal end 56*b* of the first pipe 54 is secured to the first end 62*a* of the second pipe 58, and the second end 62*b* of the second pipe 58 has a connector valve 64 mounted and adapted for removably attachment to the discharge conduit 24 of the concrete pump 20. In this embodiment, the first pipe 54 is larger in diameter than the second pipe 58. Furthermore, the water tank 60 further has an outlet aperture 72 with a release valve 74 on a bottom portion 76, for draining the water tank 60 at a water recycling facility. The water tank 60 preferably holds a volume of at least 250 gallons, and may include larger volumes (e.g., 300 gallons, 350 gallons, or more). A mounting structure 78 such as a bracket and/or other mounting hardware known in the art is used to secure the water tank 60 in place on the cement truck 30. In this embodiment, the water tank 60 is attached to the body frame 34 of the cement truck 30, adjacent the front end 36*a* of the body frame 34.

In use, the apparatus 10 is typically used following use of the concrete pump 20 for pumping concrete from the cement truck 30. Following this use, it is necessary to rinse the concrete pump 20 so that the concrete does not cure within the pump 20. As shown in FIG. 1, the discharge conduit 24 is first operably connected to the washout hook 40, which is positioned in the cement truck 30 so that concrete flowing from the washout hook 40 falls into the mixing drum 32 of the cement truck 30. The concrete pump 20 is operably connected to a water source 29 for pumping water through the concrete pump 20 so that concrete and waste water flow through the discharge conduit 24.

The discharge conduit 24 of the concrete pump 20 may include a connector valve 25 which may be used to open or close the conduit 24, for regulating the flow of materials therethrough. The connector valve 25 is initially connected to a bottom end 44 of the washout hook 40. The discharge valve 25 may be attached to the bottom end 44 of the washout hook 40 with a clamp 46 or other form of connecting or locking mechanism may be used to connect the two components. The washout hook 40 further comprises a top end 48 for directing the water and cement into the mixing drum 32. A middle hook-shaped portion 52 is positioned between the ends for hanging the hook 40 on the cement truck 30 so that the top end 48 is operably positioned adjacent the mixing drum 32 for directing the flow of concrete from the connected discharge conduit 24 into the concrete mixing drum 32.

In the configuration of FIG. 1, a user pumps concrete from the concrete pump 20 into the mixing drum 32 until water begins to flow from the discharge end 26 of the discharge conduit 24, at which time the user will close the connector valve 25 and remove the discharge end 26 from the bottom end 44 of the washout hook 40, thus preventing overhydration of the concrete within the cement truck 30 and enabling potential use of said concrete.

As shown in FIG. 2, the discharge end 26 of the discharge conduit 24 is then attached to the water channeling system 50 so that waste water from the pump 20 may flow from the discharge conduit 24 into the water tank 60 that is mounted on the cement truck 30. In the configuration of FIG. 2, the user has attached the discharge end 26 of the discharge conduit 24 to the closed connector valve on the second end of the second pipe 58. The connector valve is then opened to allow water to flow from the concrete pump 20, through the water channeling system 50, into the water tank 60 for temporary storage.

Figure 3:
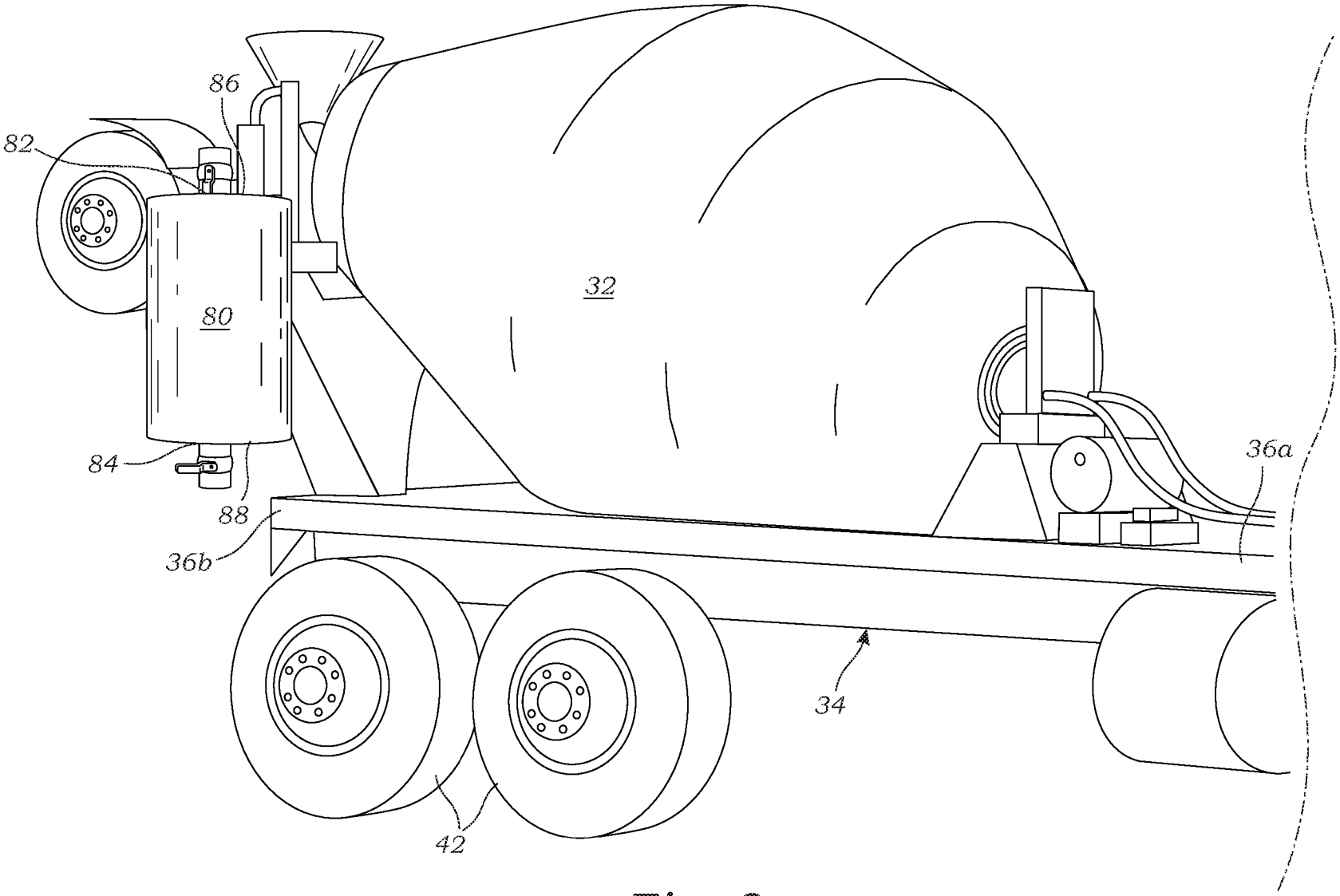
FIG. 3 is a perspective view of a second embodiment of the invention, showing a bladder mounted on a cement truck for receiving any waste water.

FIG. 3 shows a second embodiment of the invention, showing a bladder 80 mounted on the cement truck 30 having a volume of at least 250 gallons and including an entrance aperture 82 and an exit aperture 84 located on a top surface 86 and a bottom surface 88, respectively. As shown in FIG. 3, the bladder 80 serves the same function as the water tank of the first embodiment. After pumping concrete through the washout hook 40, the user connects the discharge conduit 24 to the entrance aperture 82 of the bladder 80, to properly store water and waste without overhydrating the concrete within the cement truck 30.

Using either embodiment of the present invention, water disposal may include driving the cement truck 30 to a water recycling facility, and opening the release valve 74 of the water tank 60 or the bladder 80 to allow waste water to dispense safely into the water recycling facility. The concrete in the mixing drum 32 may either be used on another job site, or poured at a recycling site where it may quickly cure and be recycled.

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A method for performing a concrete washout while recycling water used in the washout, the method comprising the steps of:

providing a concrete washout and water recycling apparatus comprising:

a water tank having a capacity of at least 250 gallons, and comprising an input aperture in a top portion of the water tank, and an outlet aperture on a bottom portion of the water tank, the second aperture having a release valve;

a mounting structure adapted for mounting the water tank on a cement truck; a water channeling system connected to the input aperture of the water tank and extending to a connector valve; providing the cement truck having a mixing drum;

providing a washout hook having a top end, a bottom end, and a middle hook-shaped portion;

providing a concrete pump having a discharge conduit that extends to a discharge end;

mounting the water tank on the cement truck via the mounting structure;

attaching the discharge end of the discharge conduit of the concrete pump to the bottom end of the washout hook;

hanging the washout hook on the cement truck so that the top end is operably positioned adjacent a mixing drum;

operably connecting the concrete pump to a water source;

pumping concrete from the concrete pump into the mixing drum until water begins to flow from the discharge end;

removing the discharge end of the discharge conduit from the bottom end of the washout hook;

attaching the discharge end of the discharge conduit to the connector valve of the water channeling system; and pumping water from the water source through the concrete pump to clean the concrete pump so that waste water from the concrete pump flows through the water channeling system, and into the water tank.

2. The method of claim 1, further comprising the steps of:

driving the cement truck to a water recycling facility; and opening the release valve to allow the waste water in the water tank to flow into the water recycling facility.

* * * * *